US005269055A

United States Patent [19]

Kessi

[11] Patent Number: 5,269,055

[45] Date of Patent: Dec. 14, 1993

[54] METHOD OF ASSEMBLING A CIRCUIT-BREAKER POLE

[75] Inventor: Erich Kessi, Unterentfelden, Switzerland

[73] Assignee: Sprecher Energie AG, Oberentfelden, Switzerland

[21] Appl. No.: 917,268

[22] Filed: Jul. 23, 1992

[30] Foreign Application Priority Data

Jul. 23, 1991 [CH] Switzerland ..... 2199/91

[51] Int. Cl.[5] ..... H01H 11/00

[52] U.S. Cl. ..... 29/622; 29/464; 29/527.1; 200/148 A; 264/275

[58] Field of Search ..... 29/622, 464, 527.1; 200/148 A, 148 B; 264/275

[56] References Cited

U.S. PATENT DOCUMENTS 2,374,058 4/1945 Webb et al. .

3,683,141 8/1972 Fawdrey et al. ..... 200/148 B 4,831,220 5/1989 Noack et al. ..... 200/148 B

FOREIGN PATENT DOCUMENTS 8325894 12/1983 Fed. Rep. of Germany .

8301812 2/1983 France .

*Primary Examiner*—P. W. Echols

*Attorney, Agent, or Firm*—Keck, Mahin & Cate

[57] ABSTRACT

In the course of the assembly of a circuit-breaker pole, the individual parts of a housing are stacked loosely one on top of the other and fixedly positioned. This fixing can be accomplished by applying subatmospheric pressure or a partial vacuum within the housing and/or by means of a holding device. Spaces open in the upward direction and located between a fitting and a support insulator as well as between a fitting and a quenching-chamber insulator are then filled with casting material. After this casting material has at least partially hardened, the circuit-breaker pole is turned upside down by rotating the holding device about a horizontal axis, whereupon spaces now open in the upward direction and located between a fitting and the quenching-chamber insulator as well as between a fitting and the support insulator are filled with casting material. This renders possible simple assembly, self-acting mutual alignment of contact pieces as well as a leak test prior to final assembly of the circuit-breaker pole.

9 Claims, 2 Drawing Sheets

METHOD OF ASSEMBLING A CIRCUIT-BREAKER POLE

BACKGROUND OF THE INVENTION

The present invention broadly relates to circuit breakers or interrupters and pertains, more specifically, to a new and improved method of assembling a circuit-breaker pole for a medium-voltage or high-voltage circuit breaker. The present invention also relates to a new and improved apparatus for carrying out or performing the inventive method as well as to a new and improved circuit-breaker pole for a medium-voltage or high-voltage circuit breaker.

Generally speaking, the method of the present invention is of the type according to which a support insulator, through which an insulating drive rod piercingly extends, is mechanically fixedly connected at one end thereof with a mechanism housing, into which there is sealingly introduced a drive element connected to the insulating drive rod, and at the other end thereof with an electrically conductive intermediate part supporting a lower terminal and electrically connected with a movable contact piece coupled to the insulating drive rod, and according to which a quenching-chamber insulator is mechanically fixedly connected at one end thereof with the intermediate part, and at the other end thereof with a top or upper housing supporting an upper terminal and a stationary contact piece co-acting with the aforesaid movable contact piece. Fittings or mounting parts are provided for the connections of the support insulator with the mechanism housing and the intermediate part, respectively, and for the connections of the quenching-chamber insulator with the intermediate part and the top housing, respectively, whereby the mechanism housing, the intermediate part and the top housing constitute the pole components for assembly with the insulators. These fittings or mounting parts are connected in each case, on the one hand, with the respective insulator by feeding casting material into a ring-shaped space between the respective insulator and the fitting or mounting part and, on the other hand, with the respective pole component.

A gas-blast insulated circuit-breaker pole of a high-voltage circuit breaker and assembled according to a prior art method of this type is disclosed, for example, in SPRECHER ENERGIE Catalog 42.B.4 "$SF_6$-Leistungsschalter", published in September, 1990 by the assignee of the instant application. Prior to pole assembly of this circuit breaker known to the art, a tubular support or post insulator and a likewise tubular quenching-chamber insulator, which are open in the axial direction, are provided with respective metal fittings or mounting parts which surround or encompass at a distance the axial end regions of the two insulators. To connect the fittings with the respective insulators, the spaces between these metal fittings and the respective insulators are filled with casting material such as, for example, Portland cement. In the course of pole assembly, the tubular support or post insulator is placed upon a mechanism housing, whereby an annular seal is previously laid on a sealing surface or face of the mechanism housing, so that the lower end face of the support insulator comes to bear upon this annular seal. The support insulator is then fixedly mounted at the mechanism housing by means of a set of screw connections supported at the lower metal fitting and at the mechanism housing. An insulating drive rod piercingly extends through the support insulator in the axial direction and the lower end thereof is connected by means of a lever-bracket gear with a drive shaft which is sealingly introduced into the mechanism housing and rotatably mounted at the latter. An intermediate part provided with a lower terminal is placed or positioned upon the support insulator after having laid a likewise annular seal therebetween. Prior thereto, there is mounted at this intermediate part a movable contact piece together with a compression system for producing the flow of quenching gas, the movable contact piece having to be connected to the insulating drive rod. The tubular quenching-chamber insulator is then put over the compression system and the movable contact piece and mounted at the tubular support or post insulator by means of a second set of screw connections which piercingly extend through the intermediate part and are supported at the upper metal fitting of the support insulator and at the lower metal fitting of the quenching-chamber insulator. A top or upper housing is deposited on the quenching-chamber insulator after having laid an annular seal therebetween, the top housing carrying a stationary contact piece co-acting with the movable contact piece. This top housing is fixedly mounted at the upper metal fitting of the quenching-chamber insulator by means of a third set of screw connections. An upper terminal of the circuit-breaker pole is provided at the top housing. Having thus completed the assembly of the circuit-breaker pole, a leak test can be now carried out.

In order to ensure that the movable contact piece is accurately aligned with the stationary contact piece, the quenching-chamber insulator with the metal fittings mounted thereat is precisely measured in a gage prior to assembly and mounting. Furthermore, checking holes are drilled into the respective metal fittings, through which alignment pins are inserted during assembly, these alignment pins being also plugged into analogous checking holes provided at the top or upper housing and the intermediate part, respectively.

It is readily conceivable that this known method of assembling and mounting a circuit-breaker pole represents a relatively time-consuming operation and requires extensive preparatory work and a corresponding expenditure for auxiliary devices. In case the result of the leak test is negative, there is no alternative but to dismount or dismantle the completed or finished circuit-breaker pole.

SUMMARY OF THE INVENTION

Therefore, with the foregoing in mind, it is a primary object of the present invention to provide a new and improved method of assembling a circuit-breaker pole for a medium-voltage or high-voltage circuit breaker, and which method does not exhibit the drawbacks of the prior art.

Another and more specific object of the present invention aims at providing a new and improved method of assembling and mounting a circuit-breaker pole and which permits a simple and easy assembly without requiring expensive auxiliary means.

A still further important object of the present invention is directed to a new and improved method of assembling a circuit-breaker pole and which method permits carrying out a leak test prior to final assembly.

Now in order to implement these and still further objects of the present invention which will become more readily apparent as the description proceeds, the method of the present development is manifested, among other things, by the steps of connecting at least one fitting or mounting part first with the respective pole component, aligning this pole component and only then feeding casting material into a space between the associated insulator and the at least one fitting, thereby connecting this fitting with the associated insulator.

In accordance with the inventive method, the parts of the circuit breaker mutually aligned subsequent to pole assembly no longer have to be accurately measured prior to assembly. Such alignment can be readily accomplished in the course of assembly, since the corresponding parts are displaceable relative to one another by virtue of the mobility of the respective fitting with respect to the associated insulator. Furthermore, storing or stock keeping is substantially facilitated, since insulators with fittings mounted thereat no longer have to be stored. By virtue of the inventive method, the insulators and the fittings can be individually stored and, in particular, these parts can be now combined on request or as required.

The mechanism housing, the intermediate part and the top housing are advantageously connected with the respective fittings or mounting parts, and the mechanism housing, the tubular support insulator, the intermediate part, the tubular quenching-chamber insulator and the top housing are stacked loosely one on top of the other, whereby the movable contact piece is displaced to engage with the stationary contact piece. The pole components are thereupon aligned and the stacked insulators together with the pole components are then fixed or fixedly positioned, whereupon the spaces open in the upward direction and located between the insulators and the fittings are filled with casting material. Subsequent to letting this casting material at least partially harden, the circuit-breaker pole is turned upside down by rotation about a horizontal axis and the remaining spaces now open in the upward direction and located between the insulators and the respective fittings are filled with casting material.

Mutual alignment of the co-acting contact pieces can be effected in a simple manner in that the movable contact piece is brought into the closed-circuit position. Since all the parts are placed only loosely one on top of the other, they can be readily moved with respect to one another with the result that the contact pieces are automatically accurately aligned.

The pole components and the insulators of the circuit-breaker pole to be assembled are preferably stacked one on top of the other in a suitable holding device which is rotatable about the aforesaid horizontal axis.

The fixing or fixed positioning of the stacked and aligned pole components and tubular insulators advantageously entails mutually tensioning the mechanism housing, the support insulator, the intermediate part, the quenching-chamber insulator and the top housing by means of the holding device.

The fixing or fixed positioning of the stacked and aligned pole components and tubular insulators can be effected by evacuating the stacked circuit-breaker pole.

A leak test is advantageously carried out prior to feeding casting material into the spaces located between the fittings and the respective insulators.

Subsequent to full hardening of the casting material in all the fittings or mounting parts, a pressure test and/or a cantilever-strength test of the finished circuit-breaker pole is carried out.

The fittings or mounting parts connected with the mechanism housing, the intermediate part and the top housing, respectively, are preferably formed at the mechanism housing, the intermediate part and the top housing, respectively.

Since the connection of the fittings with the respective tubular insulators by filling the spaces therebetween with casting material is not effected until after the assembly of the circuit-breaker pole, it is possible to do without screw connections and, accordingly, form the fittings or, as the case may be, fitting parts directly at the three pole components. There is thereby achieved the beneficial result that less parts are necessary and, in particular, less connection locations require sealing. The leak test of the complete circuit-breaker pole can be carried out before the support insulator and the quenching-chamber insulator are fixedly fastened to the respective pole components. In this manner, easy and rapid dismounting is possible in case the leak test is not passed.

An apparatus for carrying out or performing the inventive method of assembling a circuit-breaker pole comprises a holding or fixing device rotatable about a substantially horizontal axis. This holding or fixing device is provided with a support element for the mechanism housing and a retaining member for the top housing, the retaining member serving to fix or fixedly mount the circuit-breaker pole in the holding or fixing device in order to rotate the circuit-breaker pole. The support element and the retaining member are structured to be mutually tensible.

A circuit-breaker pole for a medium-voltage or high-voltage circuit breaker and assembled in accordance with the method of the present invention comprises a contact carrier removably mounted at the top housing, whereby the stationary contact piece is held or retained by this contact carrier. The top housing is provided with an opening which is gastightly closable by means of a cover, the contact carrier with the stationary contact piece being removable from the circuit-breaker pole through the opening.

The movable contact piece together with a blow-out pipe, a compression cylinder and an insulating blast nozzle, which are co-moved with the latter, as well as the insulating drive rod are also removable from the circuit-breaker pole through the opening.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters and numerals to denote the same or analogous components and wherein.

DETAILED DESCRIPTION OF THE PREFERRED EMBODIMENTS

Describing now the drawings, it is to be understood that to simplify the showing thereof, only enough of the construction of the circuit-breaker pole to be assembled and of the apparatus for carrying out the inventive method has been illustrated therein as is needed to enable one skilled in the art to readily understand the underlying principles and concepts of this invention.

Figure 1:
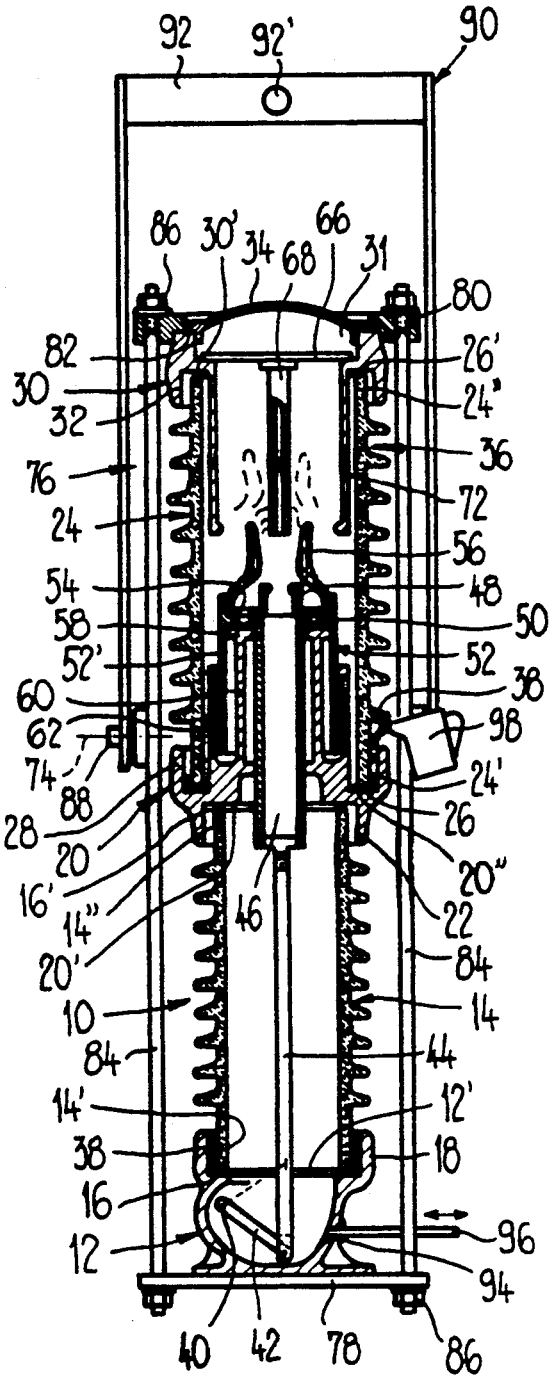
FIG. 1 schematically shows in a vertical axial sectional view a circuit-breaker pole at a moment of time in the course of assembly thereof.
Figure 2:
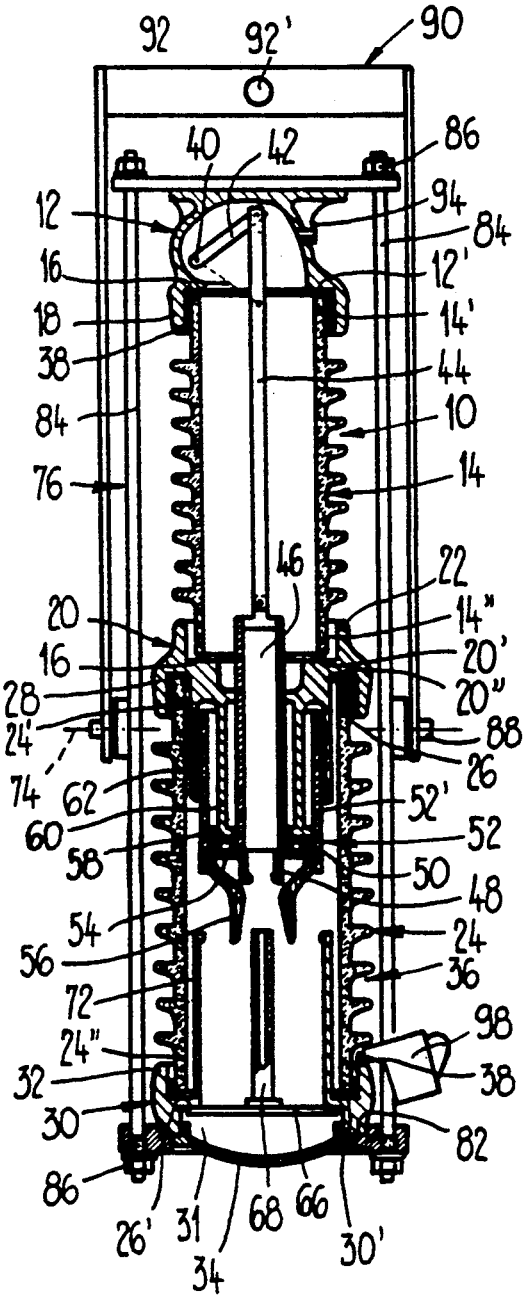
FIG. 2 schematically shows in a vertical axial sectional view the circuit-breaker pole at a later moment of time in the course of assembly.

Turning attention now specifically to FIGS. 1 and 2 of the drawings, a circuit-breaker pole 10 of a high-voltage gas-blast circuit breaker provided with an insulating and arc quenching medium, for instance sulfur hexafluoride gas ($SF_6$), and illustrated therein by way of example and not limitation will be seen to comprise a mechanism housing 12 fabricated, for instance, from cast aluminum and forming the foot or base of the circuit-breaker pole 10. A ceramic tubular support or post insulator 14 stands upright on the mechanism housing 12, whereby an annular seal 16 is provided between the insulator end face confronting the mechanism housing 12 and a corresponding sealing surface or face 12' provided at the latter. At the mechanism housing 12 there is formed a ring-shaped fitting or fitting part 18 which, with respect to the sealing surface or face 12', protrudes in the direction towards the support or post insulator 14 and thereby surrounds or encompasses at a distance a lower edge region 14' of the latter.

On the support or post insulator 14 there is arranged an electrically conductive intermediate part 20, at which there is likewise formed a sealing surface or face 20' on the lower side facing the support or post insulator 14. A further annular seal 16' is provided between the intermediate part 20 and the support or post insulator 14, this annular seal 16' bearing upon the sealing surface or face 20' and the upper end face of the support or post insulator 14. At the intermediate part 20 there is formed a ring-shaped fitting or fitting part 22 which surrounds or encompasses at a distance an upper end region 14'' of the support or post insulator 14.

A likewise ceramic tubular quenching-chamber insulator 24 is placed upon the intermediate part 20. The lower end face of this quenching-chamber insulator 24 bears upon a ring seal 26 which, in turn, rests upon a further sealing surface or face 20'' formed at the intermediate part 20. A lower end region 24' of the quenching-chamber insulator 24 is also encompassed or surrounded at a distance by a fitting or fitting part 28 likewise formed at the intermediate part 20.

At the upper end of the quenching-chamber insulator 24 there is seated a top or upper housing 30, whereby a further ring seal 26' is provided therebetween. The top housing 30 comprises at its lower side, facing the quenching-chamber insulator 24, a sealing surface or face 30' which co-acts with the further ring seal 26'. At this top housing 30 there is likewise formed a fitting or fitting part 32 which, with respect to the sealing surface or face 30', protrudes in the direction towards the quenching-chamber insulator 24 and thereby encompasses or surrounds at a distance an upper edge region 24'' of the latter. The aforesaid ring seal 26' rests upon the upper end face of the quenching-chamber insulator 24.

The top or upper housing 30 possesses on its upper side an opening 31 having a substantially circular cross-section and which is gastightly closed by a removable cover or lid 34. This cover or lid 34 is mounted at the top housing 30 by means of not particularly illustrated screws or equivalent fastening expedients. The parts or components constituting a housing 36 of the circuit-breaker pole 10, namely the mechanism housing 12, the support or post insulator 14, the intermediate part 20, the quenching-chamber insulator 24 and the top housing 30 with the cover or lid 34, are connected in that the spaces between the fitting parts 18, 22 and the support or post insulator 14 as well as the spaces between the fitting parts 28, 32 and the quenching-chamber insulator 24 are filled with a suitable casting material 38, for instance Portland cement or sulfur cement. This casting material does not assume a sealing function, but ensures purely and simply the mechanical fixed or rigid connection between the corresponding parts. The sealing function is ensured by the annular seals 16 and 16' and the ring seals 26 and 26'.

A drive shaft 40 is sealingly introduced into the interior of the mechanism housing 12, the drive shaft 40 being rotatably mounted in known and conventional manner at the latter. A drive lever 42 is keyed upon the drive shaft 40. At the free end of this drive lever 42 there is articulatedly mounted an insulating drive rod 44 which piercingly extends in the axial direction through the support or post insulator 14. The upper end of the insulating drive rod 44 is connected with a blow-out or blast pipe 46, at the upper end of which there is mounted a tulip-shaped movable contact piece 48. In the region of the upper end of the blow-out or blast pipe 46, a base or bottom 50 of a compression or pumping cylinder 52 stands out or projects from the blow-out or blast pipe 46, the compression cylinder 52 having a jacket 52' which co-axially surrounds at a distance the blow-out or blast pipe 46. This base or bottom 50 comprises flow passages 54 extending substantially in the axial direction and flow connecting a space delimited by the movable contact piece 48 and an insulating blast nozzle 56 surrounding the latter with a compression space delimited by the blow-out pipe 46 and the compression cylinder 52 as well as by an annular piston 58. This piston 58 is supported by means of supports 60 at the intermediate part 20 and integrally formed at the latter. Furthermore, the blow-out pipe 46 piercingly extends through the intermediate part 20 and is displaceably mounted at the latter.

Continuing, it will be observed that slide contact pieces 62 are arranged at the electroconductive intermediate part 20, these slide contact pieces 62 resting against the outer surface of the jacket 52' of the compression cylinder 52 fabricated from a suitable electrically conductive material, in order to electrically connect the jacket 52' with the intermediate part 20.

Figure 3:
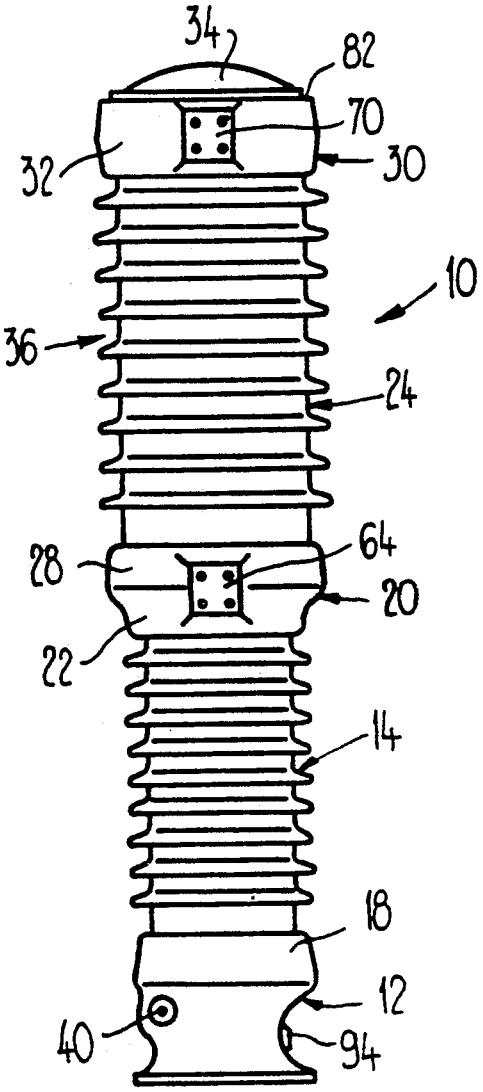
FIG. 3 schematically shows in side view the completed or finished circuit-breaker pole.

As particularly evident by referring to FIG. 3, a lower terminal or terminal pad 64 of the circuit-breaker pole 10 is formed at the electrically conductive intermediate part 20.

At the essentially annular top housing 30 there is mounted, for instance by means of screws or equivalent fastening expedients, a contact carrier 66 at which there is secured a stationary contact piece 68 co-axially arranged with respect to the longitudinal or lengthwise axis of the circuit-breaker pole 10. This stationary contact piece 68 cooperates with the tulip-shaped movable contact piece 48 and is electrically conductively encompassed by the latter in the closed-circuit position which is indicated by broken or dashed lines in FIG. 1. The stationary contact piece 68 closes or obturates thereby the neck of the insulating blast nozzle 56 formed of a suitable electrically insulating material, this neck being released upon circuit interruption.

Additionally, an upper terminal or terminal pad 70 is formed at the top housing 20, as seen by referring to FIG. 3. Furthermore, internally of the housing 36, main contact fingers 72 project from the top housing 30, these main contact fingers 72 being arranged substantially co-axially relative to the stationary contact piece 68. In the closed-circuit position, the main contact fingers 70 rest against the jacket 52' of the compression cylinder 52 and ensure an electrical connection of low impedance between the upper terminal 70 and the lower terminal 64 via the compression cylinder 52 and the slide contact pieces 62.

As shown in FIGS. 1 and 2, the circuit-breaker pole 10 is clamped or fixed in a holding or fixing device 76 which is rotatable about a horizontal axis 74. This holding or fixing device 76 comprises a plate-like support element 78 for the mechanism housing 12 as well as an annular retaining or holding member 80 which is supported externally of the region of the removable cover 34 at a shoulder 82 of the top housing 30. The plate-like supporting element 78 and the annular retaining or holding member 80 are mutually tensioned by means of tie or tension rods 84 which piercingly extend through the supporting element 78 and the retaining member 80. For this purpose, the tie or tension rods 84 are provided with screw threads at the respective end regions thereof and suitable screw nuts 86 are provided to be seated on the screw threads. Approximately at the middle sections of the tie or tension rods 84 there are provided swivel pins 88 which extend co-axially relative to the horizontal axis 74 and are journalled at lateral limbs of a U-shaped supporting bracket 90 comprising a web plate or link 92 extending transversely with respect to the aforesaid lateral limbs. At this web plate or link 92 there is provided a hole or aperture 92' for the purpose of suspending the holding or fixing device 76 at a desired location for storage of the circuit-breaker pole 10 or, as the case may be, during assembly of the circuit-breaker pole 10.

Finally, it is to be remarked that the mechanism housing 12 is provided with a connecting sleeve or pipe union 94 for rendering possible the connection to an evacuating or vacuum pump, a pressure source or a compressed-gas filling or refilling device, for example, for filling-in sulfur hexafluoride gas ($SF_6$). Such a connection is indicated in FIG. 1 by a conduit line 96.

A jug-shaped pouring ladle 98 depicted in FIGS. 1 and 2 symbolically illustrates the filling-up of respective spaces between the formed fitting parts 28 and 32 and the quenching-chamber insulator 24 with the casting material 38.

Having now had the benefit of the foregoing description of the exemplary embodiment of the circuit-breaker pole 10 as considered with respect to FIGS. 1 through 3, the assembly or mounting process in accordance with the present invention is hereinafter described and is as follows:

The mechanism housing 12 with the drive shaft 40 preassembled thereat, and with the drive lever 42 as well as with the insulating drive rod 44 is placed upon the plate-like supporting element 78. The annular seal 16 is then laid on the sealing surface or face 12' and the support or post insulator 14 is deposited on the annular seal 16. After that, the further annular seal 16' is placed on the upper end face of the support or post insulator 14, and then the intermediate part 20 with the four components preassembled thereat, namely the blow-out pipe 46, the movable contact piece 48, the compression cylinder 52 and the insulating blast nozzle 56, is placed on the annular seal 16', whereby prior thereto the drive shaft 40 was rotated in the counterclockwise direction for the purpose of bringing the drive lever 42 into the position indicated by a broken or dashed line, in order to render possible unproblematic connection of the upper end of the insulating drive rod 44 with the blow-out pipe 46, for instance by means of a pin. By virtue of this positioning of the drive shaft 40, all components connected with the blow-out pipe 46 remain in the closed-circuit position, indicated by broken lines in FIG. 1, when the intermediate part 20 is deposited on the annular seal 16'.

Subsequent to laying the ring seal 26 on the sealing surface or face 20'' of the intermediate part 20, the quenching-chamber insulator 24 is deposited on this ring seal 26 and, thereafter, the top housing 30 together with the two components preassembled thereat, namely the contact carrier 66 and the stationary contact piece 68, is deposited on the ring seal 26' previously placed upon the upper end face of the quenching-chamber insulator 24. Since the movable contact piece 48 is located in the closed-circuit position, the stationary contact piece 68 engages the movable contact piece 48, so that the two contact pieces 48 and 68 are brought into line. It should be specifically understood that all parts of the housing 36 are stacked loosely one on top of the other, so that an alignment of the individual parts is still readily possible.

After having placed the removable cover or lid 34 upon the top housing 30, the conduit line 96 is connected with a not particularly illustrated evacuating or vacuum pump in order to evacuate the circuit-breaker pole 10. The loosely stacked parts are thereby reciprocally fixed and, at the same time, a leak test can be carried out for the housing 36. If leakage is observed, rapid and unproblematic dismounting of the circuit-breaker pole 10 is still possible. By placing the annular retaining or holding member 80 upon the shoulder 82 of the top housing 30 and by tensioning the tie or tension rods 84 by means of the screw nuts 86, the circuit-breaker pole 10 is fixedly secured in the holding or fixing device 76 and, at the same time, the annular seals 16 and 16' and the ring seals 26 and 26' are still further pre-biased. If need be, a further leak test can now be carried out in that the line 96 is connected with a not particularly illustrated pressure source, in order to produce an overpressure within the housing 36.

Provided that till now all quality assurance tests and checks have been positive, all spaces open in the upward direction and located between the fitting parts and the two insulators, i.e. in this case between the fitting part 18 of the mechanism housing 12 and the support or post insulator 14 as well as between the fitting part 28 of the intermediate part 20 and the quenching-chamber insulator 24, are filled with casting material 38. After at least partial hardening of this casting material 38, the circuit-breaker pole 10 is turned upside down by rotation of the holding or fixing device 76 about the horizontal axis 74, as depicted in FIG. 2. The spaces that are now open in the upward direction and located between the respective fitting parts and the insulators, i.e. in this case between the fitting part 32 of the top housing 30 and the quenching-chamber insulator 24 as well as between the fitting part 22 of the intermediate part 20 and the support or post insulator 14, are now filled with casting material 38. As soon as this casting material has at least partially hardened, the circuit-breaker pole 10 can be rotated back to its correct position. Subsequent to the hardening of the casting material 38, the tie or tension rods 84 are loosened or released and the annular retaining or holding member 80 is removed from the top housing 30. The finished circuit-breaker pole 10, as depicted in FIG. 3, is now available for further quality assurance tests, such as a pressure test and/or a cantilever-strength test, and if need be for filling with compressed gas prior to delivery.

Figure 4:
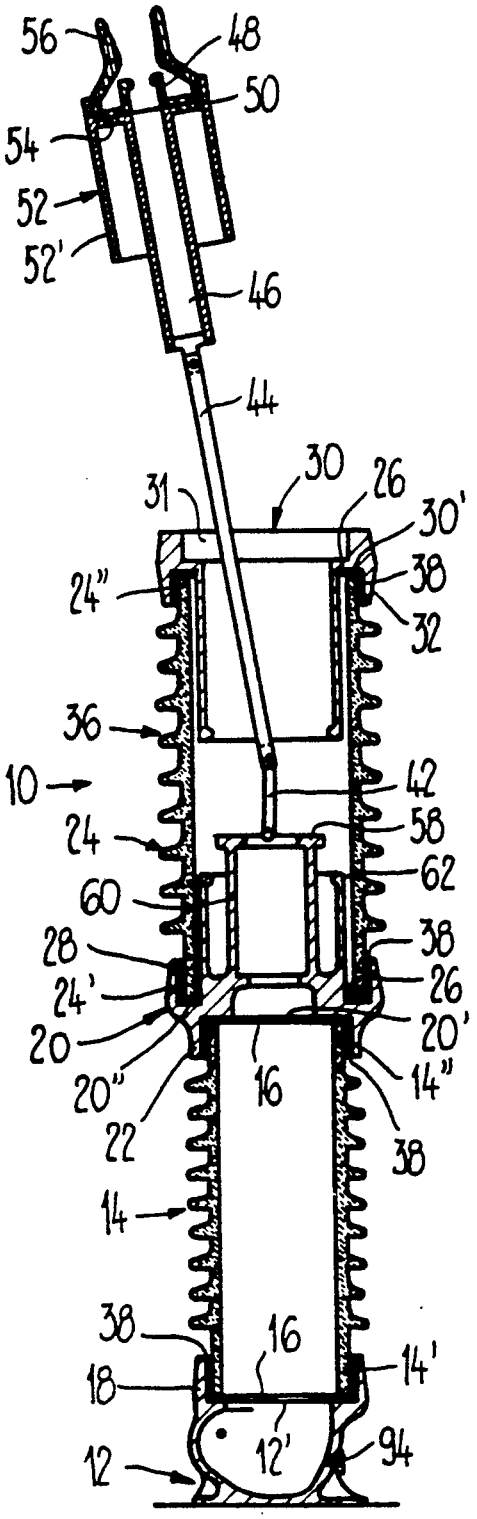
FIG. 4 schematically shows in a vertical axial sectional view the circuit-breaker pole opened at a top or upper housing and illustrated with parts removed from the circuit-breaker Pole for inspection or maintenance.

For inspection and reconditioning work, it is only necessary to remove the compressed gas from the circuit-breaker pole 10, the active circuit-breaker parts being then readily accessible after removing the cover or lid 34 from the top housing 30. Subsequent to releasing the contact carrier 66, the stationary contact piece 68 can be removed from the circuit breaker pole 10. The drive lever 42 is released by pulling out or withdrawing the drive shaft 40, whereupon the movable contact piece 48 with the insulating blast nozzle 56, the compression cylinder 52 and the blow-out pipe 46 can be withdrawn from the intermediate part 20 in the upward direction, as depicted in FIG. 4. The insulating drive rod 44 and the drive lever 42 are thereby likewise entrained. The reassembly of the parts removed from the housing 36 is carried out in the reversed order, whereby the seating or slipping-on of the drive lever 42 at the drive shaft 40 is rendered possible, for example, in that for the purpose of reaching into the mechanism housing 12 there are provided in the latter two openings aligned in the axial direction of the drive shaft 40, whereby the opening, through which the drive shaft 40 does not extend, can be closed by a suitable cover.

Of course, it is also possible in accordance with the inventive method to assemble circuit-breaker poles in which the fittings encompassing the support insulator and the quenching-chamber insulator, respectively, are not formed at the mechanism housing, the intermediate part and the top housing. Respective individual fittings are thereby mounted at the three aforementioned pole components, for example, by means of suitable screw connections or equivalent fastening expedients, and the parts of the circuit-breaker pole are stacked loosely one on top of the other and aligned before the spaces between the fittings and the insulators are filled with casting material.

The inventive method is suitable for assembling circuit-breaker poles for high-voltage as well as medium-voltage gas-blast circuit breakers and is also suitable for assembling circuit-breaker poles for circuit breakers provided with ceramic insulators as well as for circuit breakers provided with plastic insulators.

In case inspection and maintenance are not required within the circuit-breaker pole, a top housing can be provided without a removable cover.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of assembling a circuit-breaker pole for a medium-voltage or high-voltage circuit breaker, comprising the steps of:

providing a support insulator, through which an insulating drive rod piercingly extends, and a mechanism housing into which there is sealingly introduced a drive element which is connected with the insulating drive rod;

providing an intermediate part supporting a lower terminal and electrically connected with a movable contact piece which is coupled to the insulating drive rod;

providing a quenching-chamber insulator and a top housing supporting an upper terminal and a stationary contact piece which co-acts with the movable contact piece;

providing fittings for the connections of the support insulator with the mechanism housing and the intermediate part, and for the connections of the quenching-chamber insulator with the intermediate part and the top housing;

feeding casting material into respective ring-shaped spaces between the fittings and the respective insulators to connect the fittings with the support insulator and the quenching-chamber insulator, respectively;

mechanically fixedly connecting the support insulator at one end thereof with the mechanism housing and at the other end thereof with the intermediate part, and the quenching-chamber insulator at one end thereof with the intermediate part and at the other end thereof with the top housing;

said step of mechanically fixedly connecting the support insulator and the quenching-chamber insulator entailing the step of connecting the fittings with the mechanism housing, the intermediate part and the top housing, respectively;

the mechanism housing, the intermediate part and the top housing constituting pole components;

said step of providing fittings for the connections of the insulators with the respective pole components entailing the step of connecting at least one fitting first with the respective pole component;

aligning the respective pole component; and feeding casting material into a space between this at least one fitting and the associated insulator to connect this insulator with the fitting.

2. The method as defined in claim 1, further including the steps of:

following the step of connecting at least one fitting first with the respective pole component, connecting the mechanism housing, the intermediate part and the top housing with the respective fittings;

stacking the mechanism housing, the support insulator, the intermediate part, the quenching-chamber insulator and the top housing loosely one on top of the other;

to align the pole components displacing the movable contact piece such that the stationary contact piece engages the latter;

fixing the stacked insulators and pole components with respect to one another, the stacking having spaces between the fittings and the respective insulators and open in the upward direction or, as the case may be, in the downward direction;

feeding casting material into the spaces open in the upward direction;

subsequent to letting the casting material at least partially harden, turning the circuit-breaker pole upside down by rotating the latter about a horizontal axis; and feeding casting material into the remaining spaces which, subsequent to turning the circuit-breaker pole upside down, are now open in the upward direction.

3. The method as defined in claim 2, wherein:

said step of stacking the insulators and the pole components entails stacking the mechanism housing, the support insulator, the intermediate part, the quenching-chamber insulator and the top housing loosely one on top of the other in a holding device which is rotatable about the aforesaid horizontal axis.

4. The method as defined in claim 3, wherein:

said step of fixing the loosely stacked and aligned pole components and insulators entails mutually tensioning the mechanism housing, the support insulator, the intermediate part, the quenching-chamber insulator and the top housing by means of the holding device.

5. The method as defined in claim 2, wherein:

said step of fixing the loosely stacked and aligned pole components and insulators entails evacuating the assembled circuit-breaker pole.

6. The method as defined in claim 2, further including the step of:

prior to said step of feeding casting material into the spaces open in the upward direction, carrying out a leak test of the circuit-breaker pole.

7. The method as defined in claim 2, further including the step of:

subsequent to full hardening of the infed casting material in all the fittings, carrying out a pressure test of the finished circuit-breaker pole.

8. The method as defined in claim 2, further including the step of:

carrying out a cantilever-strength test of the finished circuit-breaker pole subsequent to full hardening of the casting material in the fittings.

9. The method as defined in claim 2, wherein:

said step of connecting all pole components with the respective fittings entails providing the mechanism housing, the intermediate part and the top housing with the respective fittings formed thereat.

* * * * *